US008567437B2

(12) United States Patent
Vogus et al.

(10) Patent No.: US 8,567,437 B2
(45) Date of Patent: Oct. 29, 2013

(54) MULTI-SPEED RESIN CARTRIDGE PRODUCTION SYSTEM

(75) Inventors: Charles B. Vogus, Renfrew, PA (US); Walter John Simmons, Martinsburg, WV (US); John G. Oldsen, Butler, PA (US)

(73) Assignee: J-Lok Co., Pittsburgh, PA (US)

( * ) Notice: Subject to any disclaimer, the term of this patent is extended or adjusted under 35 U.S.C. 154(b) by 318 days.

(21) Appl. No.: 12/940,342

(22) Filed: Nov. 5, 2010

(65) Prior Publication Data

US 2011/0100470 A1 May 5, 2011

Related U.S. Application Data

(60) Provisional application No. 61/258,296, filed on Nov. 5, 2009.

(51) Int. Cl.
*F16K 11/16* (2006.01)

(52) U.S. Cl.
USPC ..... 137/607; 137/897

(58) Field of Classification Search
USPC ..... 137/606, 607, 625.44, 625.45, 625.46, 137/625.47, 625.48, 896, 897
See application file for complete search history.

(56) References Cited

U.S. PATENT DOCUMENTS

| | | | | |
|---|---|---|---|---|
| 3,324,663 | A | 6/1967 | McLean | |
| 3,474,898 | A | 10/1969 | Montgomery | |
| 3,731,791 | A | 5/1973 | Fourcade et al. | |
| 3,861,522 | A | 1/1975 | Llewellyn et al. | |
| 3,889,446 | A | 6/1975 | Simmons et al. | |
| 3,996,722 | A | 12/1976 | Bernhardt | |
| 4,239,105 | A | 12/1980 | Gilbert | |
| 4,257,438 | A * | 3/1981 | Miller | 137/88 |
| 4,280,943 | A | 7/1981 | Bivens et al. | |
| 4,346,546 | A | 8/1982 | Tasker | |
| 4,470,504 | A | 9/1984 | Paban | |
| 4,497,403 | A | 2/1985 | Rausch | |
| 5,205,322 | A * | 4/1993 | Merick et al. | 137/597 |
| 5,993,116 | A | 11/1999 | Paxton et al. | |
| 6,059,880 | A * | 5/2000 | Kitano et al. | 118/52 |
| 7,411,010 | B2 | 8/2008 | Kish et al. | |
| 7,637,086 | B2 | 12/2009 | Oldsen et al. | |
| 7,681,377 | B2 | 3/2010 | Simmons et al. | |
| 7,775,745 | B2 | 8/2010 | Simmons et al. | |
| 2008/0120947 | A1 * | 5/2008 | Oldsen et al. | 53/467 |
| 2010/0183379 | A1 | 7/2010 | Simmons et al. | |

* cited by examiner

*Primary Examiner* — John K Fristoe, Jr.
*Assistant Examiner* — Reinaldo Sanchez-Medina
(74) *Attorney, Agent, or Firm* — The Webb Law Firm

(57) ABSTRACT

Provided is a system and method for producing resin cartridges that can be used in mine roof bolt applications. The system and method can be used to produce resin cartridges that contain a first portion that includes a resin and a catalyst that cure at a first speed when mixed together and a second portion that includes a resin and a catalyst that cure at a second speed when mixed together. The system can include a base material supply source, a plurality of branch lines, at least one altering material supply line in fluid communication with at least one branch line, a valve arrangement, a product line, and a packaging machine.

17 Claims, 4 Drawing Sheets

MULTI-SPEED RESIN CARTRIDGE PRODUCTION SYSTEM

CROSS REFERENCE TO RELATED APPLICATION

This application claims priority to U.S. Provisional Patent Application No. 61/258,296 filed on Nov. 5, 2009, the entire contents of which are herein incorporated by reference.

BACKGROUND OF THE INVENTION

1. Field of the Invention

The present invention is directed to a system and method for producing partitioned tubular film cartridges, and, more particularly, to a system and method for producing mine roof bolt resin cartridges that can be used to anchor bolts and other supports in mine roofs.

2. Description of Related Art

Mine roof bolts and other structural elements are often anchored into rock, concrete or the like, by a combination of adhesives and mechanical structures such as an expansion anchor at the distal end of the bolt. Bolts sized ⅝ inch to 1¼ inch in diameter are used in boreholes varying from ¾ inch to 2 inches in diameter. Adhesives are generally formed in place within the borehole by providing a resin cartridge that includes two compartments, with a polymerizable (curable) resin component in one compartment, and a hardener or catalyst component in another compartment. A borehole is drilled in the rock, and the cartridge containing the polymerizable resin and catalyst is inserted into the blind end of the borehole. When a mine roof bolt is inserted into the borehole, the distal end of the bolt ruptures the package so that the resin and catalyst components are mixed. Upon insertion of a bolt into a borehole, the bolt is rotated to shred the package and enhance mixing until the resin hardens to a degree that nearly prevents the bolt from being rotated, and the mixed composition is allowed to cure.

The most common types of resin cartridges are known as two component systems because they contain a catalyst and a resin. These two component resin cartridges are produced via a variety of techniques. In general, these techniques involve advancing a web of a film into a tube shape having a divider within the tube, thereby producing a partitioned tube. One compartment of the partitioned tube receives the resin component and the other compartment of the partitioned tube receives the catalyst component. The tube is sealed off at intervals to produce lengths of the filled package. The partitioned package is filled in a packaging machine that receives a stream of a curable resin into one compartment and a stream of catalyst in the other compartment. The resin and the catalyst are prepared in separate mixing vessels and are transferred to the packaging machine. The preparation and transfer of the resin and the catalyst has conventionally been conducted in batch operations or semi-continuous operations with minimal feedback or process controls. U.S. Pat. No. 3,889,446 (Simmons et al.) provides an example of such a process.

Another type of resin cartridge, known as a two-speed resin cartridge, contains, for example, in a first compartment, both a fast and a slow setting resin and, in a second compartment, a catalyst. As used herein, a "fast setting resin" is a resin that has a short time to set up or "gel" when in contact with a catalyst. Equivalently, a "slow setting resin" is a resin that has a long setting time. Typically, the faster setting resin will also have a faster cure time, where the cure time is the time it takes for the resin to achieve full adhesive strength. The setting time of a resin is usually affected by the chemical make up of the resin and the catalyst components.

Like with the two-component resin system described above, the fast and slow setting resins are separated from the catalyst in the cartridge so that a reaction is prevented prior to rupturing the barrier dividing the compartments. The use of two resins of distinct setting speeds permits bolt-pretensioning. The faster setting resin is disposed toward one end of the cartridge while the slower setting resin is disposed toward the other end of the cartridge. The two-speed cartridge is typically inserted into the borehole so that the end containing the faster resin abuts the top of the borehole allowing a bolt inserted into the borehole to be anchored by the resin at the top of the hole first. Orienting the cartridge in such a way, with the faster end inserted first, is important to the success of the anchoring medium to provide support. For instance, once the bolt has been anchored at the top of the borehole, a nut may be tightened at the opposite end of the bolt to apply a compressive force to an associated support plate abutting the mine roof surface to help compress and support the mine roof. After the nut has been sufficiently applied, the slower setting resin disposed toward the other end of the bolt can fully solidify to anchor the remaining portion of the bolt in the borehole.

Currently, two-speed resin cartridges, while known, are not widely available in the United States primarily due to the manufacturing difficulties and costs associated with their manufacture. Typically, a faster setting and slower setting resin are pumped from individual tanks to a resin cartridge packaging machine through individual feed pipes, each of which is associated with a pump and a valve at the end near the packaging machine. The operator then alternately selects from the resins in the feed pipes for injection into a cartridge to create a two-speed resin cartridge. However, the resins and catalysts used in roof bolt operations are highly viscous and flow through piping in a laminar fashion. These properties make it difficult to cleanly and quickly transition from one resin to another during the cartridge filling process. In some instances, four to ten times the amount of resin that is contained in the pipes and pumps of a cartridge filling system is lost as waste while making these transitions. Typical resin transition lengths within the cartridge can run up to 200 mm or more, while it is desirable to keep the transition lengths around 25 mm so that most of the bolt is in tension during setting. Moreover, the individual pumps must be started and stopped when changing between the different resins, which uses a great deal of energy and puts elevated strain on the valves that hold back the mass of material in the feed pipes. In addition, using multiple single-resin, two component system layouts to produce cartridges having multiple setting times requires a separate mixing and piping system for each resin time. Multiplying the number of pumps and piping running to the packaging machine exponentially increases the complexity of the overall production system and further increases waste.

SUMMARY

In one non-limiting embodiment, the present invention is directed to a system for producing resin cartridges that contain a first portion that sets at a first speed when ruptured by a mine roof bolt or other rupturing device and one or more subsequent portions that sets at a different speed when subjected to the rupturing force.

The system may include a base material supply source, a plurality of branch lines in fluid communication with the base material supply source, at least one altering material supply line in fluid communication with at least one of the branch lines, a valve arrangement for selecting a valve output composition from among the base materials in the multiple branch lines, and a product line configured to transfer the valve output composition to a packaging machine where it can be injected into a resin cartridge.

In another non-limiting embodiment, the present invention is directed to a method of producing resin cartridges that contain a first portion that sets at a first speed when ruptured by a mine roof bolt or other rupturing device and one or more subsequent portions that set at a different speed when subjected to the rupturing force.

The method may include the steps of feeding a supply base material into a plurality of branch lines, adding an altering material to the supply base material in at least one of the branch lines, feeding the branch lines into a valve arrangement, selecting as a valve output composition the base material contained in one of the branch lines, transferring the valve output composition to a packaging machine, and injecting the valve output composition into a resin cartridge. The method can further include the step of selecting a second valve output composition from a different branch line and injecting the second valve output composition into the resin cartridge.

DETAILED DESCRIPTION

The present invention is described with reference to producing resin cartridges that contain a first portion that set at a first speed when ruptured by a mine roof bolt or other rupturing device and one or more subsequent portions that set at a different speed when subjected to the rupturing force. Each portion of the resin cartridge contains a resin component and a catalyst component, typically separated from one another by a pliable film barrier. As used herein, the term "catalyst" means a substance that initiates polymerization when combined with a polymerizable resin component. When the cartridge is ruptured, the resin can mix with the catalyst and the catalyst can effect polymerization of the associated resin. The resin cartridges produced by the method and system described herein are particularly useful in anchoring mine roof bolts. However, this use is exemplary only and not meant to be limiting. The resin cartridges produced according to the present invention may be used to anchor other structural compounds. Moreover, the resin cartridges manufactured according to the present invention may be used for housing other components that may or may not be reactive when mixed.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 1A:
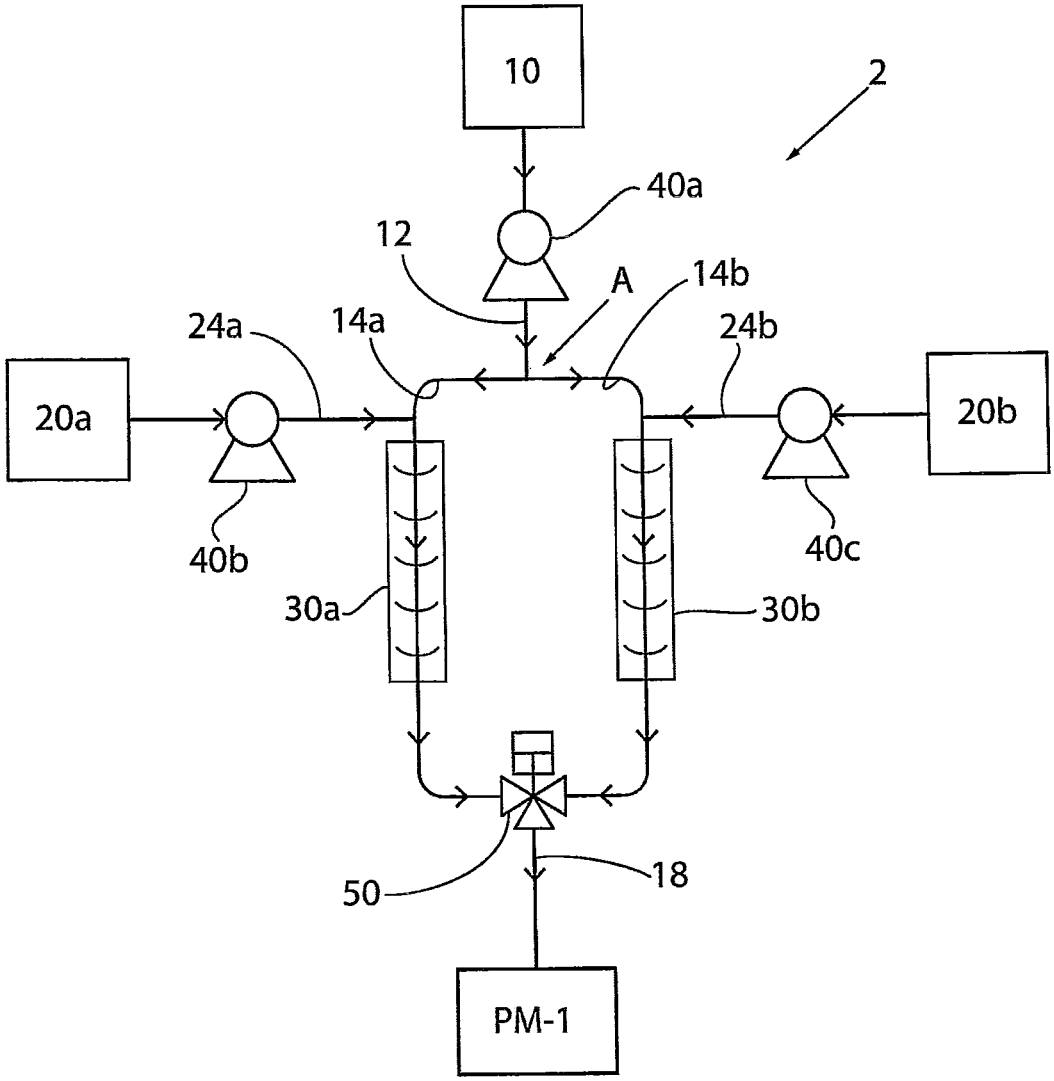
FIG. 1*a* is a schematic of the system of the present invention including one non-limiting embodiment of the valve assembly.
Figure 1B:
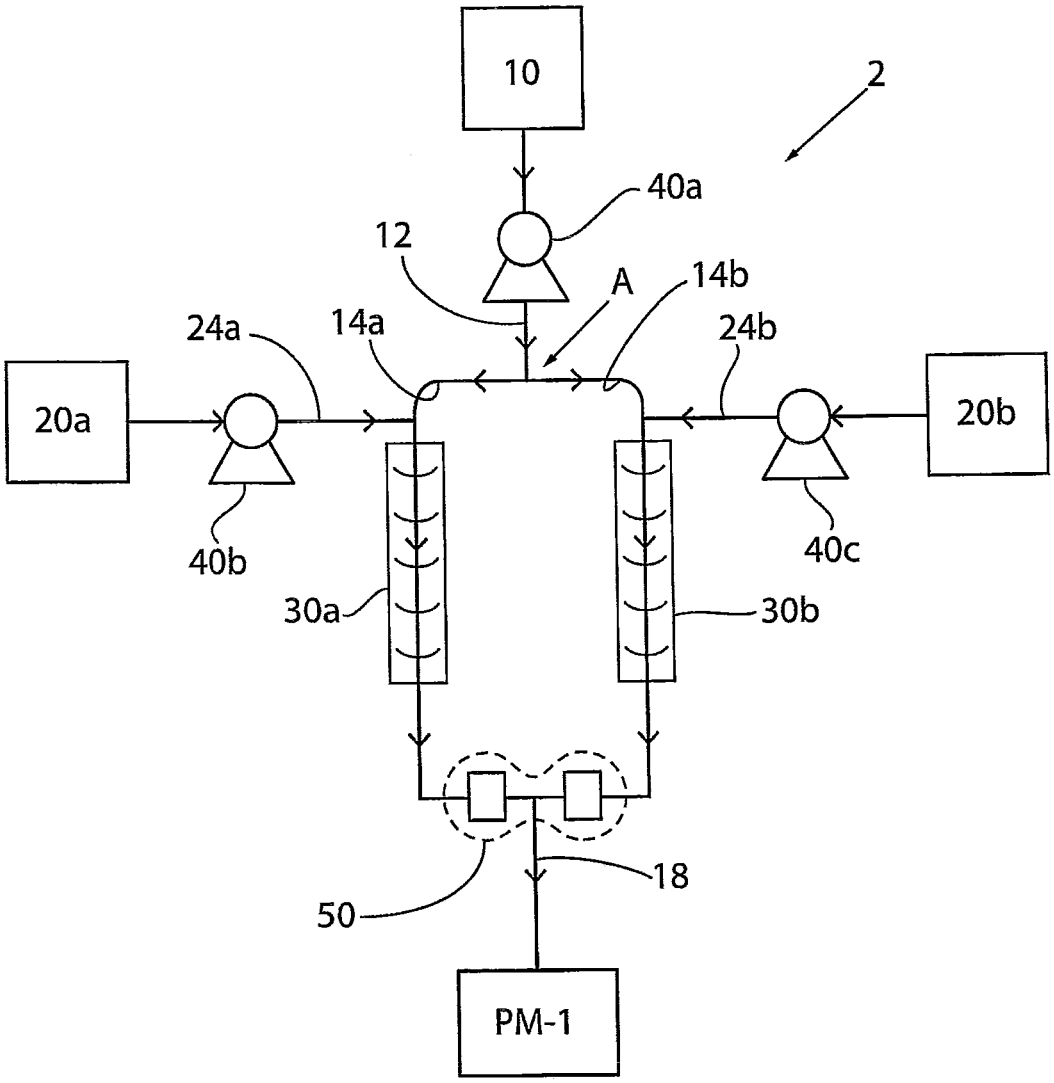
FIG. 1*b* is a schematic of the system of the present invention including another non-limiting embodiment of the valve assembly.

FIGS. 1*a* and 1*b* represents a schematic of the system 2 of the present invention for delivering a base material to a packaging machine. The packaging machine is not shown in detail in the drawings and is not limited hereby, except that the packaging machine is suitable for packaging reactive components into a partitioned package. One non-limiting example of a packaging machine is the packaging machine shown and described in U.S. Pat. No. 3,889,446 (Simmons et al.), the contents of which are expressly incorporated herein by reference.

In one non-limiting embodiment, a system 2 is provided to produce a resin cartridge containing up to three portions where each portion contains a resin and associated catalyst. The resin and catalyst components are initially kept separate from one another within the package by way of a barrier. Rupturing of the barrier causes the resin and catalyst to mix, effecting cure of the resulting mixture. The resin/catalyst mixture associated with at least one of the portions sets at a rate distinct or different from the setting rate of a resin/catalyst mixture associated with another portion of the resin cartridge. In this sense, the resin cartridge is considered a multi-speed resin cartridge.

Figure 2:
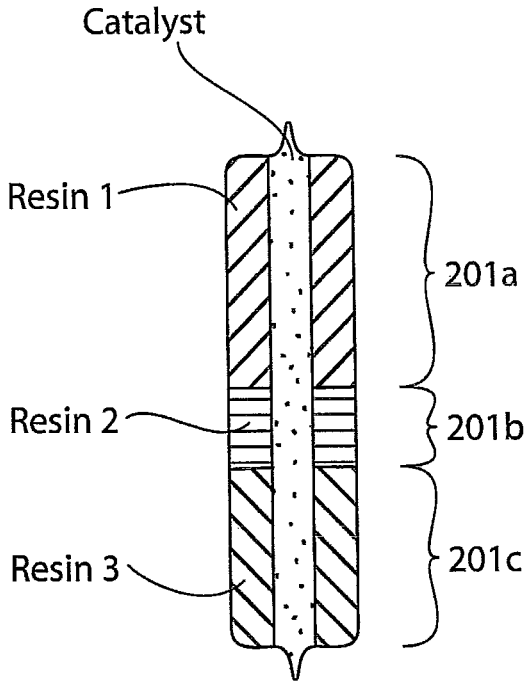
FIG. 2 shows an exemplary embodiment of a three-speed resin cartridge.
Figure 3:
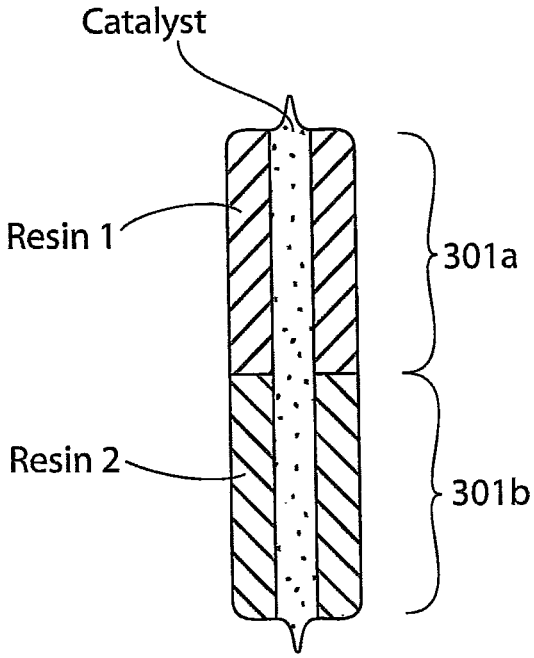
FIG. 3 shows an exemplary embodiment of a two-speed resin cartridge.

FIG. 2 shows an example of a cartridge containing three portions (201*a*, 201*b*, 201*c*). When mixed, the resin and catalyst components in each of portions 201*a-c* sets at a speed that is unique from the speed at which a mixture of the resin and catalyst components of another portion would set. For example, the resin/catalyst combination in portion 201*a* set a first speed, the resin/catalyst combination in portion 201*b* set at a second speed, and the resin/catalyst combination in portion 201*c* set at a third speed. In another non-limiting example, shown in FIG. 3, the cartridge contains two portions (301*a*, 301*b*), each including a resin and associated catalyst that, when mixed, create a mixture that sets at a distinct rate from a corresponding mixture of the resin and catalyst in the other portion. Of course, cartridges having more than three portions are also envisioned.

Referring again to FIGS. 1*a* and 1*b*, a base material, which may be, for example, a catalyst or resin, is provided from the base material supply source 10. Base material supply source 10 is intended to represent any element or combination of elements that can act to supply a base material, such as a catalyst or resin, to downstream portions of system 2. In one non-limiting embodiment, base material supply source 10 is a supply tank (not shown) containing large quantities of a base material that is continually refilled and replenished by a constant or repeated influx of base material. A series of valves, pumps, mixers and pipes could also be provided in an operational relationship with a supply tank to properly distribute the base material to the system 2. In another non-limiting embodiment, base material supply source 10 could be the output section of a system for producing a base material through mixing, reacting and/or combining various chemical compounds and other additives. The details of preparing useful base materials such as catalysts and/or resins is beyond the scope of this application, but would be understood by those skilled in the art.

If the base material is a catalyst, potential, non-limiting catalysts for use as the base catalyst include, but are not limited to, peroxide types such as benzoyl peroxide (BPO) with a water or oil base. Other such catalysts include cyclohexone peroxide, hydroxyl heptyl peroxide, 1-hydroxy cyclohexyl hydroperoxide-1, t-butyl hydroperoxide, 2,4-dichlorobenzoyl peroxide and the like, methyl ethyl ketone peroxide as well as inorganic peroxides alone or mixed with organic peroxides, such as sodium percarbonate, calcium peroxide, or sodium peroxide. Potential catalysts are listed in U.S. Pat. No. 3,324,663 (McLean), the contents of which are expressly incorporated herein by reference. Such catalysts are commercially available from a variety of sources.

As mentioned above, the base material can also be a resin. Potential resins for use as the base resin include, but are not limited to, polyester with a styrene monomer cross-linking agent as well as acrylates and acrylic resins and combinations thereof, unsaturated polyester resins dissolved in suitable ethylenically unsaturated monomer or mixture of monomers such as styrene, alpha methyl styrene, vinyl toluene, and methyl methacrylate. Potential resins are provided in U.S. Pat. Nos. 3,731,791 (Fourcade et al.) and 5,993,116 (Paxton et al.), the contents of which are expressly incorporated herein by reference. Such resins are commercially available from a variety of sources.

In some non-limiting embodiments, the base material provided by base material supply source 10 may also contain additives such as fillers or other particulate matter. The relative amount of particulate matter that is added to, for instance, a catalyst or resin, as a filler material affects the cost and performance of the final resin cartridge. Potential fillers for use with the system include, but are not limited to, limestone, fly ash, sand, and talc, and limestone is particularly useful. Additional fillers may include calcite, granite, basalt, dolomite, andesite, feldspars, amphiboles, pyroxenes, olivine, iron oxides, gabbro, rhyolite, syenite, diorite, dolerite, peridotite, trachyte, obsidian, quartz, vitrified clay, slag, cinders, and glass cullet. Thus, the base materials described herein may include these filler materials or other additional materials, as would be appreciated by one skilled in the art.

Mass meters can be employed to accurately control the amount of fillers added to a base material. In some non-limiting embodiments, filler may be added to the base material at base material supply source 10 or at a point upstream of base material supply source 10 such as in a mixing station. While the base material provided to system 2 from base material supply source 10 may already contain the appropriate levels of filler material, system 2 can additionally include subsystems (not shown) downstream of base material supply source 10 for adding filler materials at various points throughout system 2 prior to packaging machine PM-1.

Base material is transferred from base material supply source 10 through base material supply line 12 to a downstream section of system 2. This transfer can be accomplished via a system of valves and pumps, and a metering pump 40*a*, such as a mass or volume meter, may be useful to measure and control the flow rate of base material from base material supply source 10.

At a downstream section of system 2, base material supply line 12 can "split" into multiple branch lines 14*a*, 14*b*. This split point is designated as point "A" in FIG. 1. It is also contemplated that one or more branch lines 14*a*, 14*b* can extend directly from base material supply source 10, so long as fluid communication exists between base material supply source 10 and branch lines 14*a*, 14*b*. While only two branch lines are shown, it is anticipated that a system having additional branch lines, such as three, four, or five, could be used. The flow of base material continues downstream through the respective branch lines 14*a*, 14*b* as shown by the arrows in FIG. 1, which designate the general direction of flow through the system.

At a point downstream from split point A, a branch line, such as branch line 14*a*, can come into fluid communication with altering material supply line 24*a*. Altering material supply line 24*a* can extend between altering material supply source 20*a* and branch line 14*a*. Altering material can be transferred from altering material supply source 20*a* through altering material supply line 24*a* to branch line 14*a* via a system of valves and pumps, and a metering pump 40*b*, such as a mass or volume pump, may be useful to measure and control the flow rate of altering material from altering material supply source 20*a* to branch line 14*a*.

Similarly, in some non-limiting embodiments, at a point downstream from split point A, another branch line, such as branch line 14*b*, can come into fluid communication with another altering material supply line 24*b*. Altering material supply line 24*b* can extend between altering material supply source 20*b* and branch line 14*b*. Altering material can be transferred from altering material supply source 20*b* through altering material supply line 24*b* to branch line 14*b* via a system of valves and pumps, and a metering pump 40*c* may be useful to measure and control the flow rate of altering material from altering material supply source 20*b* to branch line 14*b*.

The length of branch lines 14*a*, 14*b* is not particularly limited, and may be varied depending on, for example, the number of altering material supply lines in communication therewith. However, shorter branch lines 14*a*, 14*b* can be replaced more easily and in a cost effective manner in the event they become contaminated or stained by the passing base material if it is desired to use the system 2 with another base material. Branch lines 14*a*, 14*b*, as well as altering material supply lines 24*a*, 24*b*, product line 18 (each discussed below) and other material lines that may be utilized in the invention can be made of any suitable material, with metal or plastic cylindrical tubing or piping being preferred.

The flow rate of altering material through altering material supply lines 24*a*, 24*b* and into branch lines 14*a*, 14*b* can be adjusted based on the total flow rate of the base material in branch lines 14*a*, 14*b* after addition of the altering material. In one embodiment, the flow rate of altering material is no more than 5% (by volume) of the flow rate of the base material, such as 1% by volume or less.

Altering material supply sources 20*a*, 20*b* can each provide a material that, when added to the base material, whether it be a catalyst, resin, or other material, can affect or alter the setting time of the resin/catalyst mixture in the resin cartridge containing the base material modified with the altering material. Thus, as can be appreciated, the amount of altering material added to the base material is determined primarily by the type of altering material, the effect the altering material has on the setting time, and the desired setting time of the final resin/catalyst mixture.

For example, if the base material is a catalyst, the altering material can be selected to be a material that will either inhibit or promote the reaction (i.e., slow down or speed up the setting time) between the catalyst and the associated resin in a resin cartridge upon rupturing of a partition in the resin cartridge or otherwise allowing the catalyst and resin to mix. Similarly, if the base material is a resin, the altering material can be one which will either promote or inhibit the reaction between the resin and the associated catalyst in a resin cartridge.

In one embodiment, each of the altering material supply sources 20*a*, 20*b* provides a different altering material or a different concentration of the same altering material. Some non-limiting examples of useful altering materials include inhibitor and promoter compounds. Non-limiting examples of useful inhibitors include, but are not limited to, naphthoquinone as well as hydropuinone, monoalkyl phenols, including monotertiary butyl phenol, monotertiary butyl hydroquinone, ortho-, meta- and para-cresol, higher alkyl phenols, polyhydricphenols, including catechol, resorcinol, and the partially alkylated polyhydric phenols, including eugenol, guaiacol, and mixtures of these, as listed in U.S. Pat. No. 3,324,663 (McLean), which is expressly incorporated herein by reference. Other free radical inhibitors can also be used. Non-limiting examples of useful promoters are also listed in U.S. Pat. No. 3,324,663 (McLean). Some suitable promoters include, but are not limited to, aniline promoters, such as dimethyl-, diethyl-, and/or di-n-propylaniline. A further description of adding altering materials to a catalyst is provided in U.S. Pat. No. 7,775,745 (Simmons et al.), the contents of which are expressly incorporated herein by reference.

Altering material supply sources 20*a*, 20*b* represent any element or combination of elements that can act to supply an altering material to altering material supply lines 24*a*, 24*b*. In one non-limiting embodiment, altering material supply sources 20*a*, 20*b* are supply tanks containing large quantities of the altering material that can continually be replenished. A series of valves, pumps, mixers and pipes can be provided in operational relationship with the tanks to distribute the altering material into altering material supply lines 24*a*, 24*b*. In another non-limiting embodiment, altering material supply sources 20*a*, 20*b* could be the output portion of a system for producing an altering material through mixing, reacting and/or combining various chemical compounds and other additives. The details of preparing useful altering materials is beyond the scope of this application, but would be understood by those skilled in the art.

Optionally, other modifiers, including modifiers that may or may not significantly affect the cure speed of a resin/catalyst mixture, such as stabilizers, gelling agents, thickeners, dyes and pigments, can be added to the base material. Addition of these modifiers can be done by incorporating them into the altering material(s) at, upstream, or downstream of the altering material supply sources 20*a*, 20*b* or by a separate process in which one or more modifier supply lines (not shown) are provided in fluid communication with branch lines 14*a*, 14*b* in a manner similar to that described above with respect to the interaction between altering material supply lines 24*a*, 24*b* and branch lines 14*a*, 14*b*. In one non-limiting embodiment, a dye material is mixed with the altering material either at the altering material supply source 20*a*, 20*b* or at another point along the altering material supply line 24*a*, 24*b*. The dye material, along with the altering material, is then combined with the base material in branch lines 14*a*, 14*b*. Because the altering material can be selected to alter the setting speed of a resin/catalyst mixture from the setting speed of a resin/catalyst mixture that does not include the altering material, adding a dye material simultaneously with the altering material provides certain advantages. For example, by combining the dye with the altering material (which is then added to the base material), one can visually determine where in the resin cartridge the base material supplemented with altering material is disposed based on the presence (or absence) of the dye material. In a resin cartridge, this is an easy and accurate way of determining the relative setting times of the various portions (201*a-c*, 301*a-b*) along the length of the cathidge. Preferably, the color of the dyes selected are each unique from one another and also unique from the original color of the base material.

Of course, it is also envisioned that a particular branch line 14*a*, 14*b* could have no associated altering material supply line 24*a*, 24*b* to allow the base material to flow through any or all branch lines 14*a*, 14*b* of system 2 to packaging machine PM-1 without being modified by the altering material. A similar effect can be produced by simply stopping flow from one of the altering material supply lines 24*a*, 24*b* for an appropriate time period to allow the base material in the corresponding branch line 14*a*, 14*b* to flow through system 2 without having altering material added thereto.

While the base material progresses through the branch lines 14*a*, 14*b*, one or more mixing devices 30*a*, 30*b* can be used to ensure a proper level of integration of the base material and the added materials, such as the altering materials, dyes, etc. In one non-limiting embodiment, mixing devices 30*a*, 30*b* are static mixers, for example mixers comprised of baffles incorporated within branch lines 14*a*, 14*b*. Mixing devices 30*a*, 30*b* can be incorporated along one section of branch lines 14*a*, 14*b*, along multiple sections, or along the entire length of branch lines 14*a*, 14*b*. In a preferred embodiment, mixing device 30*a*, 30*b* is disposed immediately after the point where the altering material is added to branch lines 14*a*, 14*b* to ensure that the altering material and/or dye material adequately mixes with the base material. In one non-limiting embodiment, the mixing apparatus can ensure that the base material and added materials is at least 50% mixed, such as uniformly mixed. However, in some instances it may be desired that only minimal mixing occurs in branch lines 14*a*, 14*b* in favor of having the mixing occur during rupturing of the resin cartridge. For instance, mixing by mixing devices 30*a*, 30*b* may be less than 1%, so that mixing occurs during use of resin cartridge in a bore hole.

After the altering materials, dyes, and other additives have been added to the base material in branch lines 14*a*, 14*b*, the branch lines 14*a*, 14*b* feed into a valve arrangement 50. If there are two branch lines, valve arrangement 50 can include a single 3-way valve configured to independently select base material flow from one of the branch lines 14*a*, 14*b* as an input to the valve and allowing the base material contained in the selected valve input source to pass through valve arrangement 50 as a valve arrangement output composition and into product line 18. All flow from the unselected branch lines 14*a*, 14*b* can be stopped at the inlet to valve arrangement 50. If there are, for example, three branch lines, valve arrangement 50 can include a 4-way valve configured to independently select base material flow from one or more of the branch lines. Valves that can accept multiple input streams and select among the multiple input streams to provide a single output stream are considered "multi-input" valves for purposes of this application. A valve arrangement 50 comprised of a single 3-way valve is shown in FIG. 1*a*.

In another non-limiting embodiment, shown in FIG. 1*b*, the valve arrangement 50 can include a separate, single input/single output valve associated with each of the branch lines 14*a*, 14*b*. When such a valve is in the "on" or "open" position, base material from an associated branch line can flow through valve, and when valve is switched to the "off" or "closed" position, no base material can flow through the valve. In this embodiment, the separate valves can operate in conjunction with one another to provide base material flow from a particular branch line 14*a*, 14*b* to product line 18 at a given time.

Valves of valve arrangement 50 can be any type of available valve. Non-limiting examples of types of valves that can be used include ball valves and rotor valves. Valves of valve arrangement 50 should be able to quickly switch between the various input ports or between an open and closed position. In a preferred embodiment, the switch time between a first and second input port, or between an open and closed position if the valve has a single input, is 16 milliseconds or less, such as 0.8 milliseconds or less.

The switching time of valve can also be tied to the volume of base material to be provided to the resin cartridge. In one embodiment, the switching time of such a valve is sufficiently quick that the volume of base material provided by valve during the switching operation fills 2.0 inch or less, such as 0.2 inch or less, of the associated compartment of the resin cartridge. In another embodiment the valve(s) of valve arrangement 50 are sized so that the volume of base material contained within a valve at a given time is 2.0% or less, such as 0.2% or less, of the volume of the resin cartridge. By limiting the amount of material that passes through valve while transitioning between inputs, the transition length in the cartridge is also limited. Valve(s) of valve arrangement 50 should also be able to handle thick materials flowing in a laminar or near laminar fashion into the input ports. Valves should be made of a resilient material that can withstand prolonged exposure to corrosive materials. Valves should also be capable of being automated when connected to an appropriate computer network.

A product line 18 can extend from valve arrangement 50 and into packaging machine PM-1 in order to transfer the valve arrangement output composition to packaging machine PM-1 where the composition is then injected into the appropriate compartment of the resin cartridge. The distance from valve arrangement 50 to packaging machine PM-1 is preferably short, such as between one and three feet, to allow the base material flowing into packaging machine PM-1 to quickly correspond to the base material from the selected valve input source without an undue delay period in which the previously selected valve input source continues to flow into packaging machine PM-1. In other words, a short product line 18 is preferred.

Packaging machine PM-1 receives a base material, in the form of valve arrangement output composition, from product line 18 for injection into one compartment of a resin cartridge and another material from a separate supply pipe (not shown) for injection into a separate compartment. For example, if the system 2 described above is used with a catalyst as a base material, the system 2 can be used in conjunction with a system for providing resin to the packaging machine PM-1. In such an arrangement, the resin system could provide resin to packaging machine PM-1 for injection into one compartment of the resin cartridge while the system 2 could provide catalyst to packaging machine PM-1 for injection into a separate compartment of the resin cartridge. Similarly, if the system 2 described above is used with a resin as a base material, the system 2 can be used in conjunction with a system for providing catalyst to the packaging machine PM-1 to create a resin cartridge.

A suitable packaging machine PM-1 is described in U.S. Pat. No. 3,889,446 (Simmons et al.). Generally, such packaging machines produce resin cartridges by forming a web of pliable film into an advancing first tube with the edges of the tube overlapping each other. A second tube is formed therein by advancing another film into the first tube, thereby creating a second tube within the first tube, i.e., one compartment within another compartment. Alternatively, an edge of the first tube may span the diameter of the tube to create side-by-side compartments. These are only examples of packaging techniques and are not meant to be limiting. Packaging machine PM-1 further may include one or more packaging pumps for delivering materials into the two compartments of the packaging. The packaging advances as it is filled until a pre-determined length (such as two to three feet) is filled. Packaging machine PM-1 seals the compartments together and cuts the length of filled packaging at the seal, yielding a cartridge with one compartment containing a base material provided from system 2, optionally having along its length amounts of base material of different setting speeds, and another compartment containing another material that can react with the base material. It is also envisioned that packaging machine PM-1 can create a compartment that is partitioned along its length to separate, for instance, one section of base material having a first amount or type of altering material from a second section of base material having a second amount or type of altering material.

Figure 4:
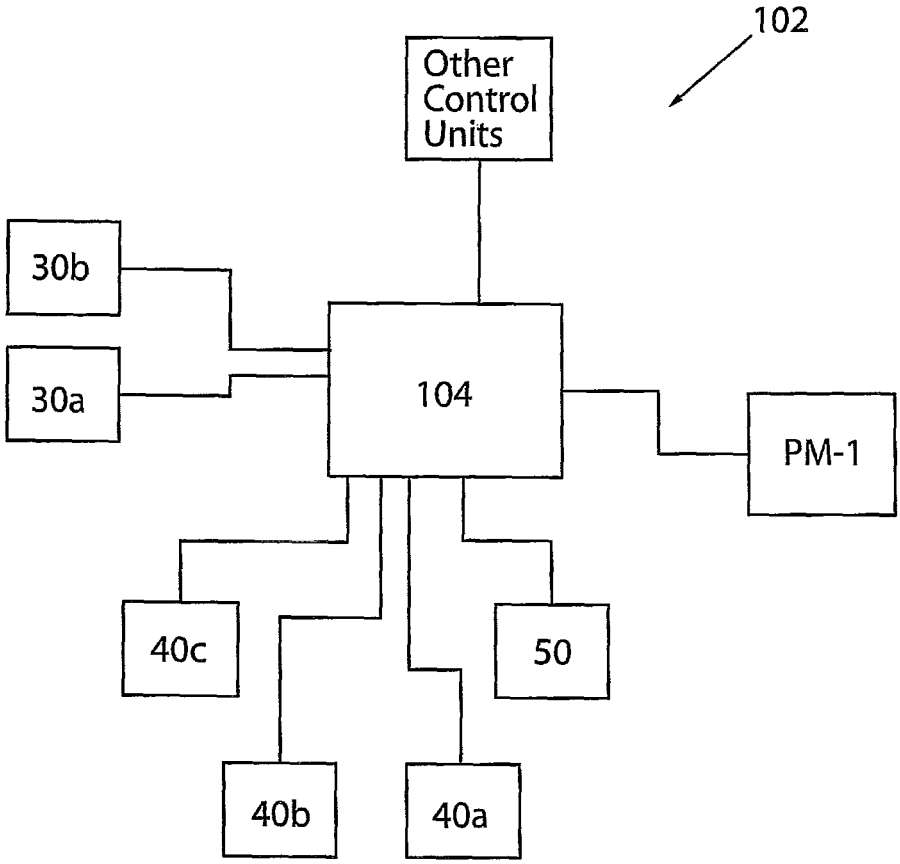
FIG. 4 is a schematic of a computer network for controlling the system of the present invention.

Referring to FIG. 4, the system of the present invention can include a computer network 102 for controlling system 2 via a remote station. Network 102 includes numerous components in mutual communication via a central processor 104. Central processor 104 can be programmed for controlling and coordinating the delivery rates of base material and altering materials by, for example, controlling the flow rates through metering pumps 40*a-c*. Central processor 104 can also be programmed to control and coordinate delivery of filler, additives, dyes and modifiers. Perhaps most importantly, central processor 104 can be programmed to activate the operation of valve arrangement 50 in order to transition the source of the valve arrangement output composition provided to product line 18 from a first branch line 14*a* to a second or subsequent branch line 14*b*. Central processor 104 also coordinates with packaging machine PM-1 to ensure the resin cartridges are produced with the appropriate amount of base material and other materials that may be supplied by a separate pipe. The flow rate of altering material may be synchronized with packaging machine PM-1 and valve arrangement 50 to provide the desired setting time and indexing to the cartridge clips or ends of the cartridge in order to allow the packaging film to be marked to show the different portions.

In other non-limiting embodiments, a system 2 in which the base material supply line 12 splits into three, four, five, etc., up to "n" number of branch lines 14*a*, 14*b* . . . 14*n* is envisioned. Branch lines 14*a-n* could all originate from a common split point A in supply line 12 or system 2 could contain multiple split points where a first branch line 14*a* subsequently splits into two or more branch lines at a point downstream from the original split point A. As mentioned above, one or more of branch lines 14*a-n* could also originate at the base material supply source 10. Increasing the number of branch lines increases the number of different (modified) base materials that can be provided to packaging machine PM-1. Each branch line 14*a-n* could be provided in fluid communication with corresponding altering material supply lines 24*a-n* and/or modifier lines to provide inhibitors, promoters, dyes, modifiers, etc., to the base material in branch lines 14*a-n*. In one embodiment where three branch lines 14*a-c* are present, valve arrangement 50 could include a 4-way valve, including inlets for all three branch lines 14*a-c* as well as a single outlet for product line 18. Similarly, if five branch lines 14*a-e* are present, valve arrangement 50 could include a 6-way valve, including inlets for all five branch lines 14*a-e* as well as a single outlet for product line 18.

The systems 2, 102, 104 described herein may be used in conjunction with or as a subset of the systems described in United States Patent Application Publication No. 2008/0120947 (Oldsen et al.), issued as U.S. Pat. No. 7,637,086, the contents of which are incorporated herein by reference.

Also provided is a method of producing resin cartridges using the system 2 described above. The method includes a step of providing a base material, such as from a base material supply source. The base material can be, for example, a resin or a catalyst. The method further includes a step of feeding the base material into a plurality of branch lines. This can be accomplished such as described above, where the base material supply line 10 "splits," such as at split point "A," into two or more branch lines 14*a*, 14*b*. The method further includes a step of adding at least one altering material to the base material flowing through at least one of the branch lines 14*a*, 14*b*.

As described above, the altering material can be provided from an altering material supply source 20*a*, 20*b* through an altering material supply line 24*a*, 24*b* in fluid communication with a corresponding branch line 14*a*, 14*b*. The altering material can be, for example, a promoter or an inhibitor. The method can further include a step of adding a dye to the base material. The dye can be added in various ways. For instance, the dye can be added to the altering material or the dye can be added directly to the base material at a point along one of the branch lines 14*a*, 14*b*. The method also includes a step of feeding each of the branch lines 14*a*, 14*b* into a valve arrangement 50. The valve arrangement 50 can select from between the various branch lines 14*a*, 14*b* and provide an output composition, which corresponds to the base material in the selected branch line, as an output of the valve assembly 50. This output is then transferred to a packaging machine PM-1 where it is injected into a resin cartridge.

As can be appreciated from the above description, the present system and method allows for the production of resin cartridges in a more efficient and effective manner than with prior art systems and methods. In particular, a single stream of base material can be provided to the system at a substantially constant mass flow rate. Splitting the input base material into a plurality of branch lines, adding the altering materials, dyes and other modifiers to the base material in the individual branch lines, and then selecting from among the various branch lines as the input to the packaging machine using a quick-changing valve assembly allows for the base material to maintain a more steady flow through the system. This greatly reduces the momentum changes that are necessary when stopping and starting the flow of the base material as well as the starting and stopping of the pump providing the base material from the base material supply source. The reduction in the momentum variations saves considerable energy and wear on the pump and valves of the system. Furthermore, the pressure on opposite sides of the valves of the valve arrangement is more balanced, reducing the wear on the valves. Moreover, using valves in the valve arrangement that can quickly toggle between the selected input (for a multi-input valve) or between open and closed (for a single input/output valve) create clean cutoffs in the type of base material provided to the packaging machine, resulting in sharper transitions between the different portions or sections of the resin cartridge.

It will be readily appreciated by those skilled in the art that modifications may be made to the invention without departing from the concepts disclosed in the foregoing description. Accordingly, the particular embodiments described in detail herein are illustrative only and are not limiting to the scope of the invention which is to be given the full breadth of the appended claims and any and all equivalents thereof.

What is claimed is:

1. A system for producing resin cartridges, comprising:

a base material supply source comprising a supply of a catalyst or a resin;

at least first and second branch lines each in fluid communication with the base material supply source;

at least one altering material supply line in fluid communication with at least one of the first and second branch lines;

a valve arrangement adapted to select between the first and second branch lines to provide first and second valve arrangement output compositions; and a product line configured to transfer the first and second valve arrangement output compositions to a packaging machine configured to produce resin cartridges having more than one compartment where the first and second valve arrangement output compositions are injected into a first compartment of the resin cartridge.

2. The system of claim 1, wherein there are two branch lines.

3. The system of claim 2, wherein the valve arrangement comprises a 3-way valve having two input ports and a single output port.

4. The system of claim 3, wherein the 3-way valve is adapted to switch between a first position to a second position in 16 milliseconds or less.

5. The system of claim 1, wherein the valve arrangement comprises a valve having multiple input ports and a single output port.

6. The system of claim 1, wherein the valve arrangement comprises a valve adapted to switch between a first position and a second position in 16 milliseconds or less.

7. The system of claim 1, further comprising at least one mixing device disposed in at least one of the branch lines.

8. The system of claim 1, further comprising an altering material supply source in fluid communication with the altering material supply line, wherein the altering material supply source comprises a supply of a promoter or an inhibitor.

9. A method of producing resin cartridges, comprising the steps of:

feeding a base material into a plurality of branch lines, wherein the base material comprises a catalyst or a resin;

adding an altering material to the base material in at least one of the plurality of branch lines;

feeding the base material from the branch lines into a valve arrangement;

selecting as a first valve arrangement output composition the base material in one of the branch lines;

transferring the first valve arrangement output composition to a packaging machine where the first valve output arrangement output composition is injected into a first compartment of a resin cartridge, the resin cartridge having more than one compartment;

selecting as a second valve arrangement output composition the base material in a different branch line; and transferring the second valve arrangement output composition to the packaging machine where the second valve arrangement output composition is injected into the first compartment of the resin cartridge.

10. The method of claim 9, wherein the base material is a resin.

11. The method of claim 10, wherein the altering material is a promoter or an inhibitor.

12. The method of claim 9, wherein the base material is a catalyst.

13. The method of claim 12, wherein the altering material is a promoter or an inhibitor.

14. The method of claim 9, wherein the base material is split into two branch lines and the valve arrangement comprises a 3-way valve.

15. The method of claim 9, wherein the altering material is a promoter or an inhibitor.

16. The method of claim 9, further comprising the step of adding a dye material to the base material in at least one of the branch lines.

17. A resin cartridge produced according to the method of claim 9.

* * * * *